US005893014A

United States Patent [19]

Goto et al.

[11] Patent Number: 5,893,014

[45] Date of Patent: Apr. 6, 1999

[54] DEVELOPING DEVICE AND DEVELOPER CARRYING MEMBER

[75] Inventors: Hiroshi Goto, Itami; Shuichi Nakagawa, Suita; Yoichi Fujieda, Nishinomiya; Ryuji Inoue, Itami, all of Japan

[73] Assignee: Minolta Co., Ltd., Osaka, Japan

[21] Appl. No.: 72,452

[22] Filed: May 5, 1998

[30] Foreign Application Priority Data

May 8, 1997 [JP] Japan ..... 9-118185
May 8, 1997 [JP] Japan ..... 9-118186

[51] Int. Cl.[6] ..... G03G 15/08

[52] U.S. Cl. ..... 399/286; 399/279; 399/284

[58] Field of Search ..... 399/265, 272–274, 399/279–281, 284, 286; 492/18

[56] References Cited

U.S. PATENT DOCUMENTS

| | | | |
|---|---|---|---|
| 5,168,312 | 12/1992 | Aoto et al. . | |
| 5,170,213 | 12/1992 | Yamaguchi et al. . | |
| 5,245,391 | 9/1993 | Suzuki et al. | 399/285 |
| 5,245,392 | 9/1993 | Behe et al. | 399/266 |
| 5,473,418 | 12/1995 | Kazakos et al. | 399/284 |

FOREIGN PATENT DOCUMENTS

| | | |
|---|---|---|
| 62-19749 | 4/1987 | Japan . |
| 63-55709 | 11/1988 | Japan . |
| 3-141377 | 6/1991 | Japan . |
| 7-9552 | 2/1995 | Japan . |

*Primary Examiner*—Matthew S. Smith
*Attorney, Agent, or Firm*—Burns, Doane, Swecker & Mathis, LLP

[57] ABSTRACT

In a developing device according to the present invention, a developer carrying member in which a dielectric layer is formed on the surface of a conductive base substrate is used. In conveying a monocomponent developer containing no carrier to a developing area opposite to the image carrying member with the developer held on the surface of the developer carrying member, to develop a latent image formed on the image carrying member by the developer, the dielectric layer in the developer carrying member satisfies the following conditions:

$$t \geqq 50,\ \in \leqq 10, \text{ and } 15 \leqq t/\in \leqq 35$$

where t ($\mu$m) is the thickness of the dielectric layer, and $\in$ is the relative dielectric constant of the dielectric layer.

25 Claims, 10 Drawing Sheets

DEVELOPING DEVICE AND DEVELOPER CARRYING MEMBER

BACKGWRAPAROUND OF THE INVENTION

This application is based on applications Nos. 118185/1997 and 118186/1997 filed in Japan, the contents of which are hereby incorporated by reference.

1. Field of the Invention

The present invention relates generally to a developing device used for developing a latent image formed on an image carrying member in an image forming apparatus such as a copying machine or a printer and a developer carrying member used for the developing device, and more particularly, to a developing device so adapted as to convey a developer to a developing area opposite to an image carrying member with the developer held on the surface of a developer carrying member as well as to regulate the amount of the developer thus conveyed to the developing area by a regulating member.

2. Description of the Related Art

In an image forming apparatus such as a copying machine or a printer, various developing devices have been conventionally used for developing an electrostatic latent image formed on an image carrying member. As such a developing device, a developing device using a monocomponent developer containing no carrier has been known in addition to a developing device using a two-component developer containing carrier and toner.

In such a developing device using a monocomponent developer, a developing device of a non-contact development type so adapted that a developer carrying member and an image carrying member are provided opposite to each other with required spacing in a developing area, and a developer is introduced into the developing area opposite to the image carrying member by the developer carrying member, to perform development, and a developing device of a contact development type so adapted that a developer is introduced into a developing area opposite to an image carrying member by a developer carrying member, and the developer held in the developer carrying member is brought into contact with the image carrying member, to perform development have been known.

In the case of the developing device of a non-contact development type so adapted that the developer carrying member and the image carrying member are provided opposite to each other with required spacing in the developing area, when the spacing between the developer carrying member and the image carrying member which are opposite to each other in the developing area is changed, the density or the like of a formed image is greatly changed. Even when the forming precision of the image carrying member and the developer carrying member is not sufficient, and the spacing between the image carrying member and the developer carrying member slightly varies, therefore, the density of the formed image is changed, so that the image is made non-uniform in density, for example.

Therefore, a method of setting the spacing between the developer carrying member and the image carrying member which are opposite to each other in the developing area to a large value of not less than 400 $\mu$m, detecting the spacing by detecting means, and changing the development conditions in a case where the spacing is changed, for example, has been conventionally used.

When the spacing between the developer carrying member and the image carrying member is made wide as described above, however, an electric field is strengthened in an edge portion of an electrostatic latent image in the image carrying member. Therefore, a so-called edge effect is produced, so that only the image density in the edge portion of the formed image is increased, and a dot image and a line image are not faithfully reproduced.

On the other hand, in the case of the developing device of a contact development type so adapted that the developer held in a developer carrying member is brought into contact with the surface of the image carrying member, to perform development, a wraparound electric field in an edge portion of an electrostatic latent image formed on the image carrying member is hardly generated, so that an image corresponding to the electrostatic latent image is faithfully developed.

When the electrostatic latent image formed on the image carrying member is thus faithfully developed, however, the variation in the electrostatic latent image formed on the image carrying member appears as it is as an image. For example, when the diameter of a laser beam for making exposure to the image carrying member differs for each apparatus, the state of the formed image greatly differs depending on whether the diameter of the laser beam is large or small.

Specifically, consider a case where thin-line electrostatic latent images are respectively formed on the image carrying member using a large-diameter laser beam and a small-diameter laser beam. In this case, in a case where the large-diameter laser beam is used, a range of a portion irradiated with the large-diameter laser beam is wider, and the intensity of the large-diameter laser beam in the irradiated portion is higher, as compared with a case where the small-diameter laser beam is used, so that a potential on the image carrying member is hardly changed. When the thin-line electrostatic latent images respectively formed on the image carrying member using the large-diameter laser beam and the small-diameter laser beam are developed by the developing device, a sufficient image density is not obtained, and a thin line is thickened in a case where the large-diameter laser beam is used, as shown in FIG. 1. Further, consider a case where the laser beams are irradiated upon being overlapped, to form a thick-line electrostatic latent image on the image carrying member, and the thick-line electrostatic latent image is developed by the developing device. In this case, in a case where the large-diameter laser beam is used, an edge portion of a line is widened, so that the line is made thicker, as compared with a case where the small-diameter laser beam is used, as shown in FIG. 2.

In the case of each of the developing devices using a monocomponent developer, in introducing the developer to the developing area opposite to the image carrying member by the developer carrying member, a regulating member is pressed against the surface of the developer carrying member holding the developer, and the amount of the developer held on the surface of the developer carrying member is regulated by the regulating member in order to introduce the developer in suitable amounts to the developing area opposite to the image carrying member.

When the regulating member is thus pressed against the surface of the developer carrying member holding the developer to regulate the amount of the developer, however, the developer held on the surface of the developer carrying member by the regulating member is cracked, producing fine powder. The fine powder is welded to the surface of the developer carrying member, for example, so that the density of the formed image is made non-uniform in a stripe shape, for example.

SUMMARY OF THE INVENTION

An object of the present invention is to provide a developing device and a developer carrying member which are improved to solve the above-mentioned various problems.

Another object of the present invention is to prevent, in a developing device of a non-contact development type using a monocomponent developer containing no carrier and so provided that a developer carrying member and an image carrying member are opposite to each other with required spacing in a developing area, a formed image from being non-uniform in density, for example, upon being changed when the spacing between the image carrying member and the developer carrying member slightly varies.

Still another object of the present invention is to obtain, in a developing device of a contact development type using a monocomponent developer containing no carrier and so adapted that a developer held in a developer carrying member is brought into contact with the surface of an image carrying member in a developing area, to perform development, the same constant image even when the diameter of a laser beam for making exposure to the image carrying member varies.

A further object of the present invention is to prevent, in a case where a regulating member is pressed against the surface of a developer carrying member while a monocomponent developer containing no carrier is being introduced into a developing area opposite to an image carrying member by the developer carrying member, to regulate the amount of the developer held on the surface of the developer carrying member by the regulating member, fine powder from being produced by the cracking of the developer, to prevent the density of a formed image from being non-uniform in a stripe shape.

A first developing device according to the present invention uses a developer carrying member in which a dielectric layer is formed on the surface of a conductive base substrate. In conveying a monocomponent developer containing no carrier to a developing area opposite to an image carrying member with the developer held on the surface of the developer carrying member, to develop a latent image formed on the image carrying member by the developer, the dielectric layer in the developer carrying member satisfies the following conditions:

$$t \geqq 50,\ \in \leqq 10,\ \text{and}\ 15 \leqq t/\in \leqq 35$$

where t ($\mu$m) is the thickness of the dielectric layer, and $\in$ is the relative dielectric constant of the dielectric layer.

As in the first developing device, when the developer carrying member in which the dielectric layer is provided on the surface of the conductive base substrate is used, an electric field exerted on a portion between the developer carrying member and the image carrying member is controlled by the dielectric layer.

When the dielectric layer satisfying the foregoing conditions is provided on the surface of the developer carrying member, the electric field exerted on the portion between the developer carrying member and the image carrying member is suitably controlled by the dielectric layer, to prevent a formed image from being non-uniform in density. Even when the beam diameter of a laser beam used for forming an electrostatic latent image on the image carrying member differs so that the electrostatic latent image formed on the image carrying member varies, the variation is reduced, to obtain a constant image.

A second developing device according to the present invention uses a developer carrying member in which a dielectric layer is formed on the surface of a conductive base substrate. In arranging the developer carrying member opposite to an image carrying member with predetermined spacing, conveying a monocomponent developer containing no carrier to a developing area opposite to the image carrying member with the developer held on the surface of the developer carrying member, and developing a latent image formed on the image carrying member by the developer, the spacing between the image carrying member and the developer carrying member is in the range of 150 to 400 $\mu$m, and the dielectric layer in the developer carrying member satisfies the following conditions:

$$t \geqq 50,\ \in \leqq 10,\ \text{and}\ 15 \leqq t/\in \leqq 35$$

where t ($\mu$m) is the thickness of the dielectric layer, and $\in$ is the relative dielectric constant of the dielectric layer.

As in the second developing device, when the developer carrying member in which the dielectric layer is provided on the surface of the conductive base substrate, an electric field exerted on a portion between the developer carrying member and the image carrying member is controlled by the dielectric layer.

When the spacing between the developer carrying member and the image carrying member is set in the range of 150 to 400 $\mu$m, and the dielectric layer satisfying the foregoing conditions is provided on the surface of the developer carrying member, an edge effect in an edge portion of the electrostatic latent image formed on the image carrying member is restrained, thereby eliminating the possibilities that only the image density in the edge portion of a formed image is increased, and a dot image and a line image are not faithfully reproduced. When the spacing between the developer carrying member and the image carrying member varies, the density or the like of the formed image is prevented from greatly varying, so that a good image having a constant image density is obtained.

The reason why the thickness t of the dielectric layer is not less than 50 $\mu$m, and the relative dielectric constant $\in$ thereof is not more than 10 is that if the thickness t of the dielectric layer is less than 50 $\mu$m, and the relative dielectric constant $\in$ thereof is more than 10, the electric field exerted on the portion between the developer carrying member and the image carrying member cannot be suitably controlled by the dielectric layer, so that the formed image is liable to be non-uniform in density in a case where the spacing between the developer carrying member and the image carrying member varies.

The reason why the thickness t of the dielectric layer divided by the relative dielectric constant $\in$ thereof ($t/\in$) is in the range of 10 to 50 is that the electric field exerted on the portion between the developer carrying member and the image carrying member cannot be suitably controlled by the dielectric layer if the value of $t/\in$ is less than 10, so that the formed image is liable to be non-uniform in density in a case where the spacing between the image carrying member and the developer carrying member varies, while the developer is also easily supplied to a non-image portion of the formed image if the value of $t/\in$ is more than 50 $\mu$m, so that the formed image is liable to be fogged.

A third developing device according to the present invention uses a developer carrying member in which a dielectric layer is formed on the surface of a conductive base substrate. In arranging the developer carrying member opposite to an image carrying member, conveying a monocomponent developer containing no carrier to a developing area opposite to the image carrying member with the developer held on the surface of the developer carrying member, and bringing the developer into contact with the surface of the image carrying member, to develop a latent image formed on the image carrying member by the developer, the dielectric layer in the developer carrying member satisfies the following conditions:

$$t \geqq 50,\ \in \leqq 10, \text{ and } 15 \leqq t/\in \leqq 35$$

where t ($\mu$m) is the thickness of the dielectric layer, and $\in$ is the relative dielectric constant of the dielectric layer.

As in the third developing device, when the developer carrying member in which the dielectric layer is provided on the surface of the conductive base substrate is used, and the monocomponent developer containing no carrier held in the developer carrying member is brought into contact with the surface of the image carrying member, to perform development, an electric field between the developer carrying member and the image carrying member is controlled by the dielectric layer formed on the surface of the developer carrying member.

When the dielectric layer in the developer carrying member satisfies the foregoing conditions, a wraparound electric field is generated in an edge portion of an electrostatic latent image formed on the image carrying member, to obtain a suitable edge effect due to the existence of the dielectric layer. When the electrostatic latent image formed on the image carrying member varies, the variation of the electrostatic latent image is not faithfully developed as it is. Even when the beam diameter of a laser beam used for forming the electrostatic latent image on the image carrying member differs, a constant image is obtained.

The reason why the thickness t of the dielectric layer is not less than 50 $\mu$m is that if the thickness t of the dielectric layer is decreased, the relative dielectric constant $\in$ thereof must be decreased in order to set the value of t/$\in$ in the range of 15 to 35 $\mu$m, so that the density of a formed image greatly varies due to the variation in the thickness t of the dielectric layer.

The reason why the relative dielectric constant $\in$ of the dielectric layer is set to not more than 10 $\mu$m is that if a material having a higher relative dielectric constant is used, the specific volume resistivity in the dielectric layer is lowered, so that an electric field between the developer carrying member and the image carrying member cannot be suitably controlled, and the variation of the electrostatic latent image formed on the image carrying member appears as it is in the formed image.

The reason why the thickness t of the dielectric layer divided by the relative dielectric constant E thereof (t/$\in$) is set in the range of 15 to 35 $\mu$m is that the electric field exerted on the portion between the developer carrying member and the image carrying member cannot be suitably controlled by the dielectric layer if the value is less than 15 m, so that the variation of the electrostatic latent image formed on the image carrying member appears as it is in the formed image, while the density of the formed image greatly varies due to the variation in the thickness t of the dielectric layer, for example, if the value is more than 35 $\mu$m, so that the formed image is made non-uniform in density.

In the above-mentioned first to third developing devices, in regulating the amount of the developer held on the surface of the developer carrying member by the regulating member, to convey the developer to the developing area opposite to the image carrying member, it is preferable that at least the surface of the conductive base substrate in the developer carrying member is composed of an elastic material having conductive properties having a rubber hardness of 10 to 70 degrees and having elongation of 400 to 1200%. In regulating the developer held in the developer carrying member by the regulating member, therefore, the surface of the developer carrying member is deformed, so that a load applied to the developer is decreased. Therefore, fine powder is prevented from being produced by the cracking of the developer, so that an image formed upon welding the fine powder of the developer to the surface of the developer carrying member, for example, is hardly made non-uniform in density. The rubber hardness and the elongation are values measured in accordance with JIS K 6301.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Developing devices according to preferred embodiments of the present invention will be specifically described on the basis of drawings.

(Embodiment 1)

Figure 1:
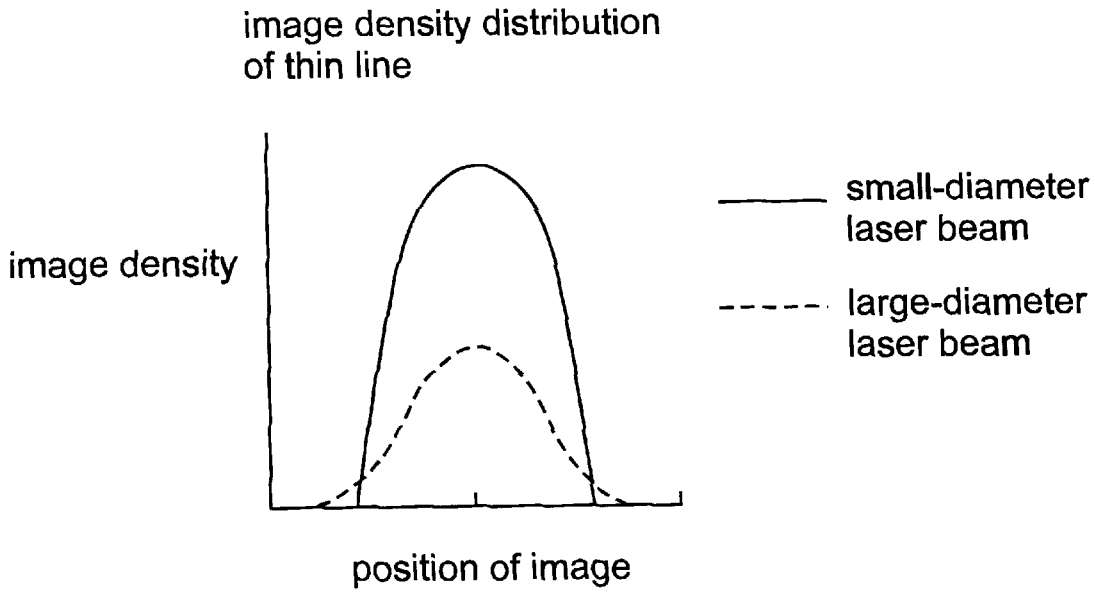
FIG. 1 is a diagram showing, in a case where thin-line electrostatic latent images are respectively formed on an image carrying member using a large-diameter laser beam and a small-diameter laser beam, and a monocomponent developer containing no carrier held on the surface of a developer carrying member is brought into contact with the surface of the image carrying member, to develop the thin-line electrostatic latent images, the image density distribution in formed images.
Figure 2:
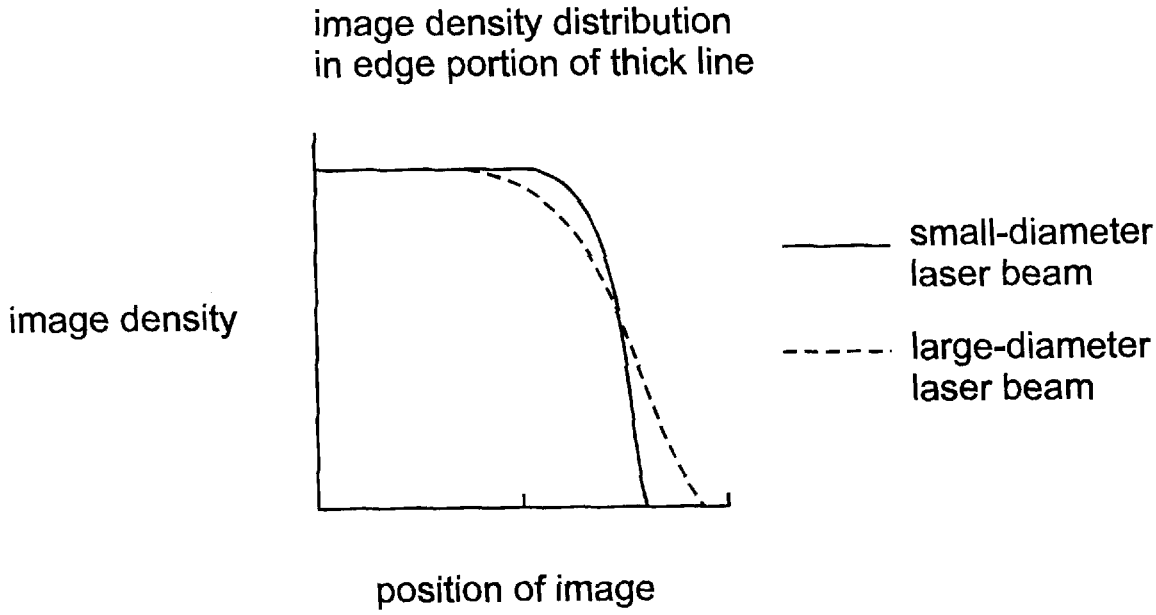
FIG. 2 is a diagram showing, in a case where thick-line electrostatic latent images are respectively formed on an image carrying member using a large-diameter laser beam and a small-diameter laser beam, and a monocomponent developer containing no carrier held on the surface of a developer carrying member is brought into contact with the surface of the image carrying member, to develop the thick-line electrostatic latent images, the image density distributions in formed images.
Figure 3:
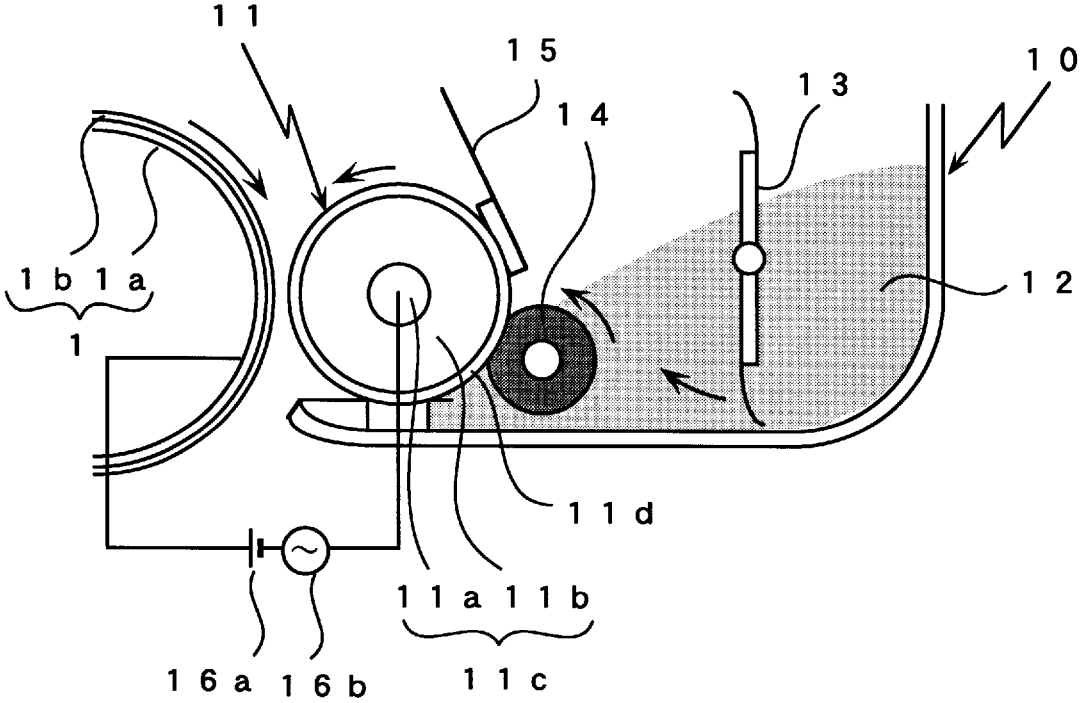
FIG. 3 is a schematic cross-sectional view of a developing device according to an embodiment 1 of the present invention.

In a developing device according to an embodiment 1, an image carrying member 1 composed of a photosensitive drum 1 in which a photosensitive layer 1*b* is formed on the surface of a cylindrical supporting member 1*a* having conductive properties is used, the surface of the image carrying member 1 is charged by a charger (not shown), and the surface of the image carrying member 1 is then irradiated with light from a suitable exposing device (not shown), to form an electrostatic latent image corresponding to image information on the surface of the image carrying member 1, as shown in FIG. 3.

Figure 4:
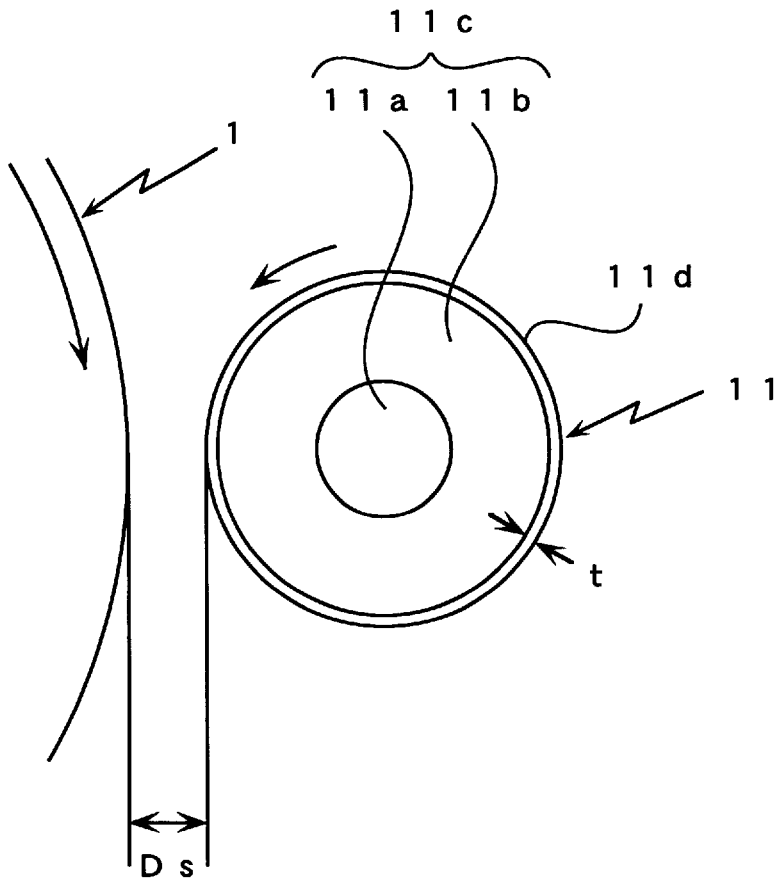
FIG. 4 is a partially explanatory view showing a state where a developer carrying member is provided opposite to an image carrying member with required spacing in the developing device according to the embodiment 1.

In the developing device, a developer carrying member 11 in which a dielectric layer 11*d* is formed on the surface of a conductive base substrate 11*c* constructed by providing an elastic layer 11*b* having conductive properties around a rotating shaft 11*a* having conductive properties is used, as shown in FIGS. 3 and 4.

Figure 5:
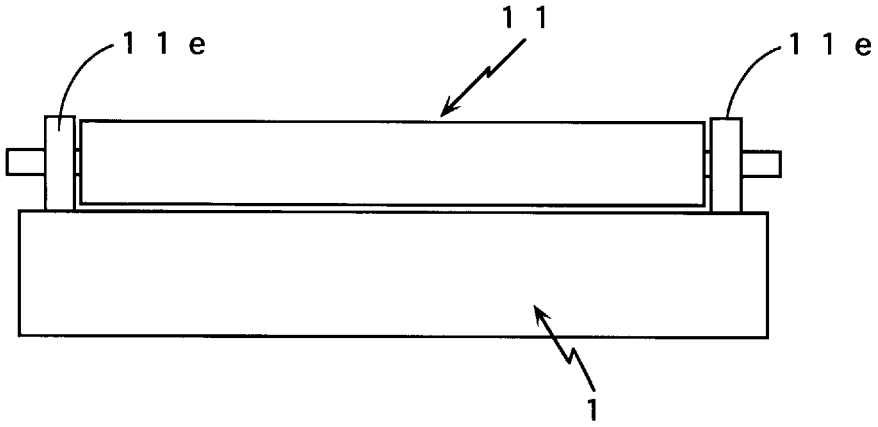
FIG. 5 is a plan explanatory view showing a state where a developer carrying member is provided opposite to an image carrying member with required spacing in the developing device according to the embodiment 1.

In providing the developer carrying member 11 opposite to the image carrying member 1 with required spacing Ds, roller members 11*e* each having a slightly larger diameter than the diameter of the developer carrying member 11 are rotatably provided on both sides of the developer carrying member 11, as shown in FIG. 5, so that the spacing Ds in a position where the developer carrying member 11 and the image carrying member 1 are opposite to each other is in the range of 150 to 400 μm by the roller members 11*e*.

Figure 6:
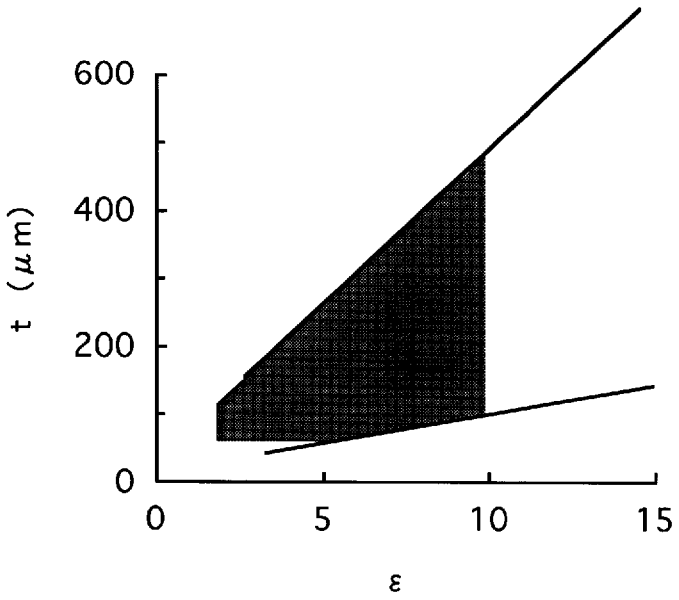
FIG. 6 is a diagram showing the ranges of the thickness t and the relative dielectric constant $\in$ of a dielectric layer provided on the surface of a developer carrying member in the developing device according to the embodiment 1.

An example of the dielectric layer 11*d* provided in the developer carrying member 11 is one having a thickness t of not less than 50 μm and composed of a material having a relative dielectric constant ∈ of not more than 10, as shown in a shaded portion in FIG. 6, so that the thickness t of the dielectric layer divided by the relative dielectric constant ∈ thereof (t/∈) is in the range of 10 to 50 μm. Examples of the material composing the dielectric layer 11*d* include various types of plastic materials, elastomer materials, and rubber materials.

In the developing device, a developer (toner) 12 is contained in the main body 10 of the developing device provided with the developer carrying member 11, and the developer 12 is fed toward the developer carrying member 11 by a rotating feeding blade 13. The developer 12 thus fed is fed to the surface of the developer carrying member 11 by a feeding roller 14 provided so as to come into contact with the developer carrying member 11, and the developer 12 thus fed is conveyed toward the image carrying member 1 by the rotation of the developer carrying member 11.

While the developer 12 is being thus conveyed to the image carrying member 1 by the developer carrying member 11, a regulating member 15 is pressed against the surface of the developer carrying member 11, to regulate the amount of the developer 12 conveyed to a developing area by the regulating member 15 as well as to frictionally charge the developer 12.

The developer 12 thus frictionally charged upon regulating the amount thereof by the regulating member 15 is introduced into the developing area opposite to the image carrying member 1 with required spacing Ds by the developer carrying member 11, a developing bias voltage in which an AC pulse voltage is overlapped with a DC voltage is applied from a DC power supply 16*a* and an AC power supply 16*b* to a portion between the developer carrying member 11 and the image carrying member 1, and the developer held on the surface of the developer carrying member 11 is supplied to an electrostatic latent image formed on the image carrying member 1, to perform development.

When the electrostatic latent image formed on the image carrying member 1 is thus developed, an edge effect in an edge portion of the electrostatic latent image formed on the image carrying member 1 is restrained, thereby eliminating the possibilities that only the image density in an edge portion of a formed image is increased, and a dot image and a line image are not faithfully reproduced. Further, the formed image is not fogged. Even when the spacing Ds between the developer carrying member 11 and the image carrying member 1 varies, the density or the like of the formed image hardly varies. Therefore, a good image having a constant image density is obtained.

In the developer carrying member 11, consider a case where an example of a material composing the elastic layer 11*b* having conductive properties provided around the rotating shaft 11*a* having conductive properties is one having a rubber hardness of 10 to 70 degrees and having elongation of 400 to 1200%. In this case, when the regulating member 15 is pressed against the surface of the developer carrying member 11 as described above, to regulate the amount of the developer 12 on the surface of the developer carrying member 11, the developer carrying member 11 is deformed, so that a load applied to the developer 12 is significantly reduced. Therefore, the developer 12 on the surface of the developer carrying member 11 is hardly cracked by pressing of the regulating member 11, so that the density of the formed image is prevented from being non-uniform in a stripe shape, for example, by welding fine powder of the developer 12 to the surface of the developer carrying member 11, for example.

It will be made clear on the basis of an experiment that the above-mentioned effect is obtained when the spacing Ds between the developer carrying member 11 and the image carrying member 1 is set in the range of 150 to 400 μm, and the dielectric layer 11*d* having a thickness t of not less than 50 μm, having a relative dielectric constant ∈ of not more than 10, and having a value of t/∈ of 10 to 50 μm is provided on the surface of the developer carrying member 11.

In this experiment, in providing the dielectric layer 11*d* on the surface of the developer carrying member 11, a thermoplastic styrene elastomer material having a relative dielectric constant ∈ of approximately 3 and a urethane material having a relative dielectric constant ∈ of approximately 8 were used as a material composing the dielectric layer 11*d*. Dielectric layers 11*d* having thicknesses of 0 μm, 50 μm, 100 μm, and 150 μm were respectively provided on the surfaces of developer carrying members 11 using each of the materials. In the dielectric layers 11*d* using the material having a relative dielectric constant ∈ of approximately 3, the values of t/∈ were respectively 0 μm, 17 μm, 33 μm, and 50 μm. On the other hand, in the dielectric layers 11*d* using the material having a relative dielectric constant ∈ of approximately 8, the values of t/∈ were respectively 0 μm, 6 μm, 12 μm, and 19 μm.

The developer carrying member 11 provided with the above-mentioned dielectric layer 11*d* was used, and the spacing (the developing gap) Ds between the developer carrying member 11 and the image carrying member 1 was changed by the roller members 11*e*, to develop a high-resolution and low-density halftone image composed of dots which has 300 screen lines, has a screen angle of 0°, and has a white-to-black ratio(a B/W ratio) of 25% under such development conditions that an image having an image density of 1.4 is obtained when a solid image is formed. The image density of a formed image was measured, to find the relationship between the image density and the developing gap Ds. The results in a case where the developer carrying member 11 provided with the dielectric layer 11*d* having a relative dielectric constant ∈ of approximately 3 was used was shown in FIG. 7, and the results in a case where the developer carrying member 11 provided with the dielectric layer 11*d* having a relative dielectric constant ∈ of approximately 8 was used was shown in FIG. 8.

As a result, in a case where the developing gap Ds was small, as the value of t/∈ in the dielectric layer 11*d* provided in the developer carrying member 11 was changed, the image density was greatly changed. As the developing gap Ds was increased, however, the image density was hardly changed, so that the image density was fixed.

Figure 7:
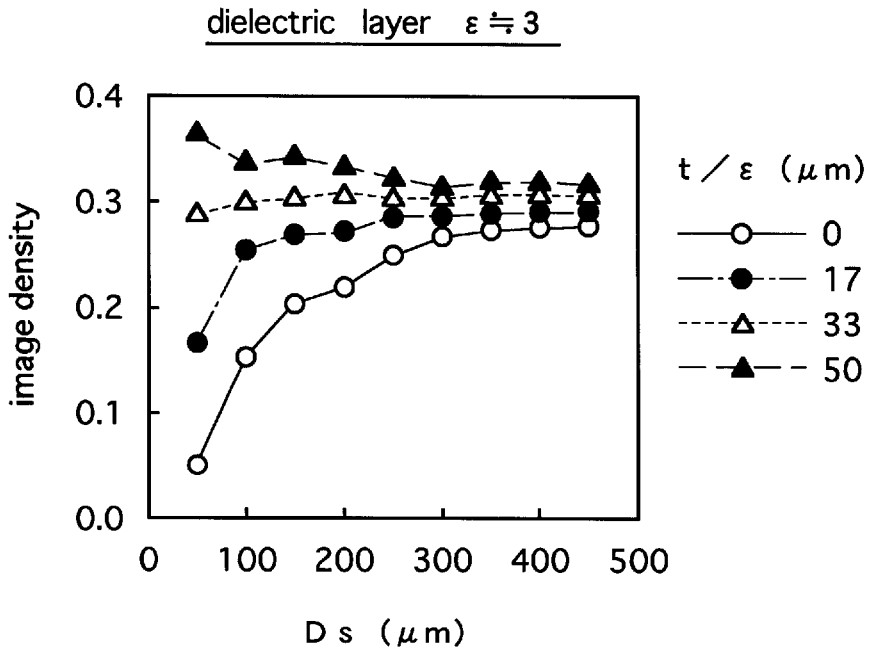
FIG. 7 is a diagram showing the relationship between an image density and a developing gap Ds in a case where a halftone image composed of dots is developed using a developer carrying member having a dielectric layer formed therein using a material having a relative dielectric constant $\in$ of approximately 3 in an experimental example using the developing device in FIG. 3.
Figure 8:
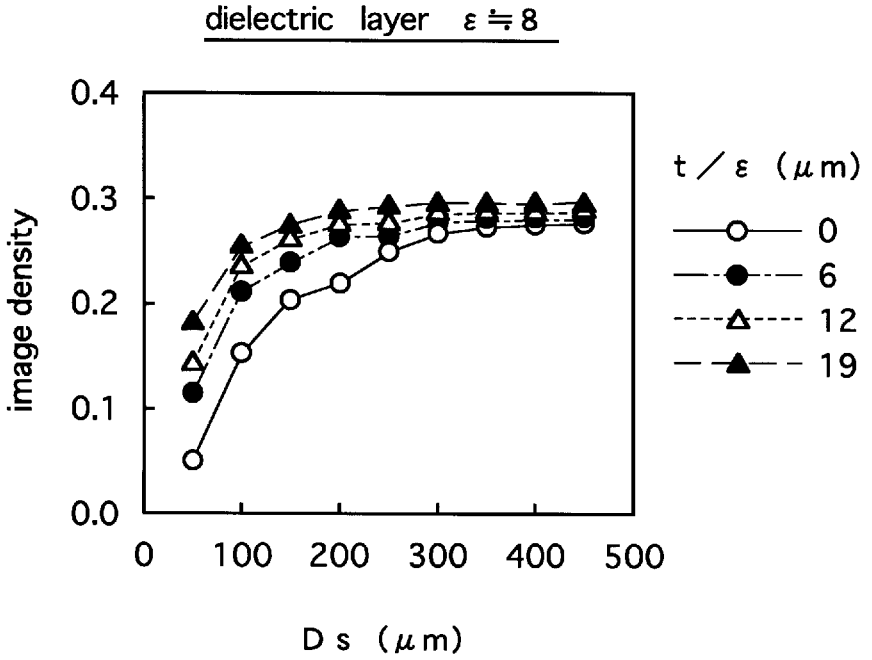
FIG. 8 is a diagram showing the relationship between an image density and a developing gap Ds in a case where a halftone image composed of dots is developed using a developer carrying member having a dielectric layer formed therein using a material having a relative dielectric constant ∈ of approximately 8 in an experimental example using the developing device shown in FIG. 3.
Figure 9:
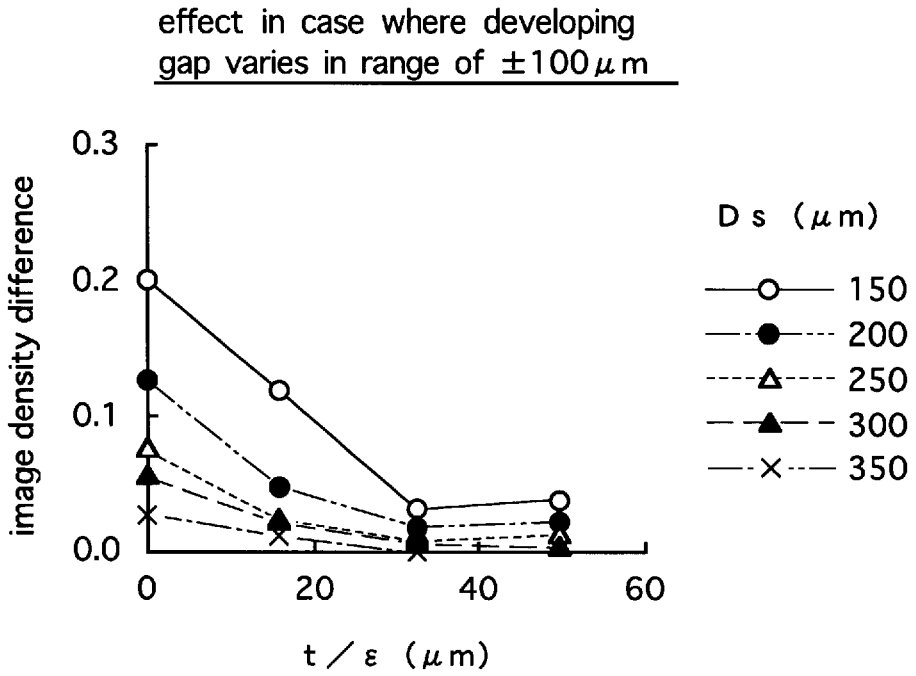
FIG. 9 is a diagram showing, in a case where halftone images each composed of dots are respectively developed using developer carrying members provided with dielectric layers which differ in the thickness t thereof divided by the relative dielectric constant ∈ thereof (t/∈) in an experimental example using the developing device shown in FIG. 3, the relationship between an image density difference occurring when a developing gap Ds varies in the range of ±100 μm and the value of t/∈.

In a case where the developing gap Ds between the developer carrying member 11 and the image carrying member 1 which were opposite to each other was set to 150 μm, 200 μm, 250 μm, 300 μm, and 350 μm on the basis of the results shown in FIGS. 7 and 8, the relationship between an image density difference occurring when the spacing Ds varied in the range of ±100 μm and the value of t/∈ was found. The results thereof were shown in FIG. 9.

As a result, in providing the dielectric layer 11*d* on the surface of the developer carrying member 11, as the value of t/∈ in the dielectric layer 11*d* was increased, the image density difference depending on the variation in the developing gap Ds was decreased. When the value of t/∈ was lower than 10 μm, the density of the formed image was greatly changed by the variation in the developing gap Ds.

Consequently, it was preferable to set the value of t/∈ in the dielectric layer 11*d* to not less than 10 μm. Particularly consider a case where the value of t/∈ in the dielectric layer 11*d* was not less than 30 μm. In this case, when the developing gap Ds was as narrow as 150 μm, the formed image had a constant and stable density even if the developing gap Ds varied.

Figure 10:
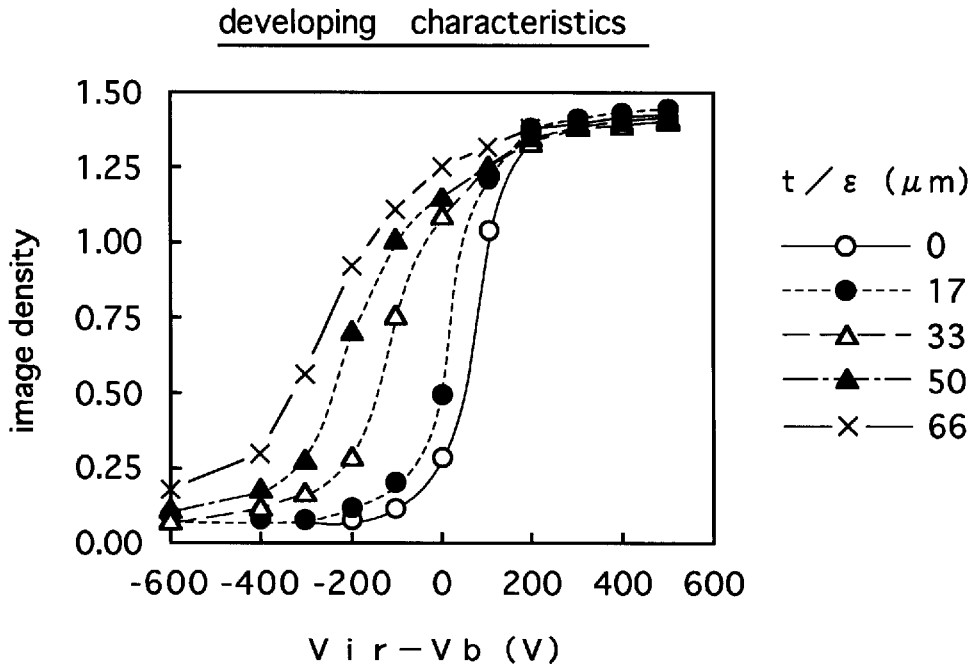
FIG. 10 is a diagram showing, in a case where development is performed using developer carrying members respectively provided with dielectric layers which differ in the value of t/∈, the relationship between a difference (Vir−Vb) between a DC bias voltage Vb applied to a portion between each of the developer carrying members and an image carrying member and a surface potential Vir of the image carrying member and the image density of a formed image.

The developer carrying members 11 respectively provided with the dielectric layers 11*d* having values of t/∈ of 0 μm, 17 μm, 33 μm, 50 μm, and 66 μm were then used, and a difference (Vir−Vb) between a DC voltage Vb applied to a portion between each of the developer carrying members 11 and the image carrying member 1 from the DC power supply 16*a* and a surface potential Vir of the image carrying member 1 was changed, to perform development. The relationship between the image density of a formed image and the value of (Vir−Vb) was examined. The results thereof were shown in FIG. 10.

As a result, in the case of the developer carrying member 11 provided with the dielectric layer 11*d* having a value of t/∈ of 66 μm, the difference (Vir−Vb) in between the DC voltage Vb and the surface potential Vir of the image carrying member 1 must be not more than −600 V so as not to fog a non-image portion of the formed image. In order to obtain a sufficient density difference between an image portion and the non-image portion, therefore, a potential difference between the image portion and the non-image portion must be significantly increased, so that it is very difficult to prevent the non-image portion from being fogged. Therefore, it was preferable to set the value of t/∈ in the dielectric layer 11*d* provided on the surface of the developer carrying member 11 to not more than 50 μm.

In providing the dielectric layer 11*d* on the surface of the developer carrying member 11 as described above, consider a case where the value of t/∈ in the dielectric layer 11*d* is set to 10 to 50 μm. In this case, when the thickness t of the dielectric layer 11*d* is decreased using a material having a small relative dielectric constant ∈, the density of a formed image is greatly changed by the variation in the thickness t of the dielectric layer 11*d*. Therefore, it was preferable to set the thickness t of the dielectric layer 11*d* to not less than 50 μm.

In providing the dielectric layer 11*d* on the surface of the developer carrying member 11, when the relative dielectric constant ∈ of the dielectric layer 11*d* is more than 10, the specific volume resistivity in the dielectric layer 11*d* is lowered, so that the electric field exerted on the portion between the developer carrying member 11 and the image carrying member 1 is not sufficiently controlled by the dielectric layer 11*d*. Even when the spacing between the image carrying member 1 and the developer carrying member 11 slightly varied, therefore, the density of the formed image was changed.

In the developing device shown in FIG. 3, in pressing the regulating member 15 against the surface of the developer carrying member 11 as described above, to regulate the amount of the developer 12 held on the surface of the developer carrying member 11, an experiment using developer carrying members 11 respectively having different types of elastic layers 11*b* having conductive properties provided around their rotating shafts 11*a* is carried out, to make it clear that the developer 12 is prevented from being cracked by pressing of the regulating member 15 when the developer carrying member 11 provided with the elastic layer 11*b* having a rubber hardness of 10 to 70 degrees and having elongation of 400 to 1200% is used.

In this experiment, toner produced in the following manner was used as the developer 12.

In producing the toner, 100 parts by weight of polyester resin (Tafton NE-1110: produced by Kao Co., Ltd.), 8 parts by weight of carbon black which is a colorant (Mogul L: produced by Cabot Co., Ltd.), 3 parts by weight a charge-controlling agent (Bontron S-34: produced by Orient Kagaku Co., Ltd.), and 2.5 parts by weight of a release agent (Biscole TS-200: produced by Sanyo Kasei Kogyo Co., Ltd.) were mixed at a speed of rotation of 2800 rpm by a Henschel mixer for three minutes, after which a mixture obtained was kneaded using a biaxial kneading extruder. The kneaded mixture was cooled, was then coarsely pulverized, was further finely pulverized by a ultrasonic jet grinding machine (manufactured by Nippon Pneumatic Co., Ltd.), and was then classified using Elbow Jet (manufactured by Matusaka Boeki Co., Ltd.), to obtain toner particles. Hydrophobic silica (Cabozil TS-500: produced by Cabot Co., Ltd.) was added in the ratio of 0.8% by weight to the toner particles. They were mixed at a speed of rotation of 2500 rpm by the Henschel mixer for 90 seconds, to produce negatively charged toner.

(EXPERIMENTAL EXAMPLE 1)

In the experimental example 1, in providing the elastic layer 11*b* having conductive properties around the rotating shaft 11*a* in the developer carrying member 11, the elastic layer 11*b* having a rubber hardness of 44 degrees, having elongation of 710%, and having a specific volume resistivity of $10^6$ Ω·cm was provided, as shown in the following Table 1 using a styrene elastomer, and the dielectric layer 11*d* having a thickness of 100 μm was provided on the elastic layer 11*b* using the material having a relative dielectric constant ∈ of approximately 3.

(EXPERIMENTAL EXAMPLE 2)

In the experimental example 2, in providing the elastic layer 11*b* having conductive properties around the rotating shaft 11*a* in the developer carrying member 11, the elastic layer 11*b* having a rubber hardness of 77 degrees, having elongation of 850%, and having a specific volume resistivity of $10^5$ Ω·cm was provided, as shown in the following Table 1 using a styrene elastomer, and the dielectric layer 11*d* having a thickness of 100 μm was provided on the elastic layer 11*b* using the material having a relative dielectric constant ∈ of approximately 3.

(EXPERIMENTAL EXAMPLE 3)

In the experimental example 3, in providing the elastic layer 11*b* having conductive properties around the rotating shaft 11*a* in the developer carrying member 11, the elastic layer 11*b* having a rubber hardness of 68 degrees, having elongation of 980%, and having a specific volume resistivity of $10^5$ Ω·cm was provided, as shown in the following Table 1 using urethane rubber, and the dielectric layer 11*d* having a thickness of 100 μm was provided on the elastic layer 11*b* using the material having a relative dielectric constant ∈ of approximately 3.

(EXPERIMENTAL EXAMPLE 4)

In the experimental example 4, in providing the elastic layer 11*b* having conductive properties around the rotating shaft 11*a* in the developer carrying member 11, the elastic layer 11*b* having a rubber hardness of 50 degrees, having elongation of 290%, and having a specific volume resistivity of $10^6$ Ω·cm was provided, as shown in the following Table 1 using silicone rubber, and the dielectric layer 11*d* having a thickness of 100 μm was provided on the elastic layer 11*b* using the material having a relative dielectric constant ∈ of approximately 3.

A printing resistance test of 10,000 sheets was then carried out using the developer carrying members 11 shown in the above-mentioned experimental examples 1 to 4, to evaluate the non-uniformities in density of formed images. The results thereof were together shown in the following Table 1. In evaluating the non-uniformities in density of the images after the printing resistance test of 10,000 sheets, a case where a good image which is not non-uniform in density was obtained was indicated by ○, and a case where an image whose density is non-uniform in a stripe shape was obtained was indicated by X.

TABLE 1

| | rubber hardness (degree) | elongation (%) | specific volume resistivity (Ω · cm) | evaluation of non-uniformity in density |
|---|---|---|---|---|
| experimental example 1 | 44 | 710 | $10^6$ | ○ |
| experimental example 2 | 77 | 850 | $10^5$ | x |
| experimental example 3 | 68 | 980 | $10^5$ | ○ |
| experimental example 4 | 50 | 290 | $10^6$ | x |

As a result, in providing the elastic layer 11*b* having conductive properties around the rotating shaft 11*a* having conductive properties in the above-mentioned developer carrying member 11, in the experimental examples 1 and 3 in which the developer carrying member 11 was provided with the elastic layer 11*b* having a rubber hardness of 10 to 70 degrees and having elongation of 400 to 1200%, when the amount of the developer 12 on the surface of the developer carrying member 11 was regulated by the regulating member 15 as described above, fine powder of the developer 12 was prevented from being welded to the surface of the developer carrying member 11, for example, by the cracking of the developer 12, so that the formed image was not made non-uniform in density.

On the other hand, in the experimental example 2 in which the developer carrying member 11 was provided with the hard elastic layer 11*b* having a rubber hardness of 77 degrees, and in the experimental example 4 in which the developer carrying member 11 was provided with the elastic layer 11*b* having small elongation of 290%, when the amount of the developer 12 on the surface of the developer carrying member 11 was regulated by the regulating member 15, the developer 12 was cracked, producing fine powder, and the fine powder was welded to the surface of the developer carrying member 11, for example, so that the density of the formed image was made non-uniform in a stripe shape.

(Embodiment 2)

Figure 11:
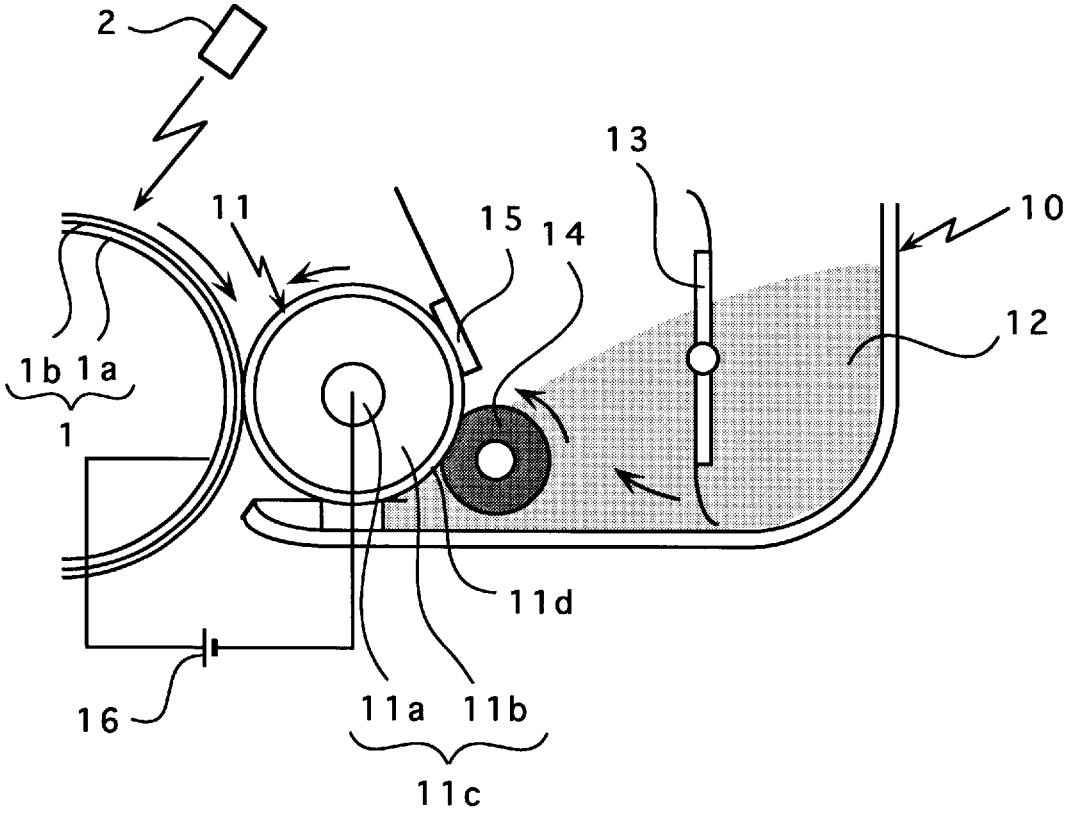
FIG. 11 is a schematic cross-sectional view of a developing device according to an embodiment 2 of the present invention.
Figure 12:
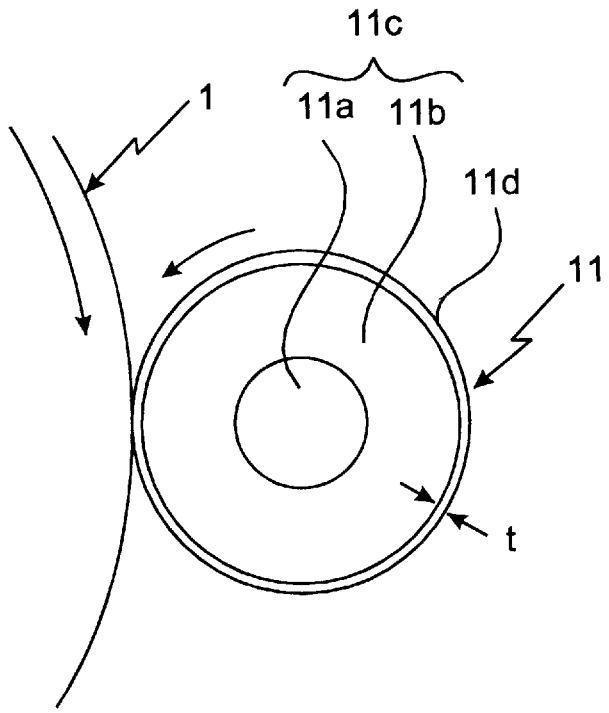
FIG. 12 is a partially explanatory view showing a state where a developer carrying member is so provided as to come into contact with an image carrying member in the developing device according to the embodiment 2.

Also in an embodiment 2, an image carrying member 1 composed of a photosensitive drum 1 in which a photosensitive layer 1*b* is formed on the surface of a cylindrical supporting member 1*a* having conductive properties is used, the surface of the image carrying member 1 is charged by a charger (not shown), and the surface of the image carrying member 1 is then irradiated with light from a suitable exposing device (not shown), to form an electrostatic latent image corresponding to image information on the surface of the image carrying member 1, as shown in FIGS. 11 and 12.

In the developing device in the embodiment 2, a developer carrying member 11 is provided opposite to the image carrying member 1 so as to come into contact with the surface of the image carrying member 1.

Figure 13:
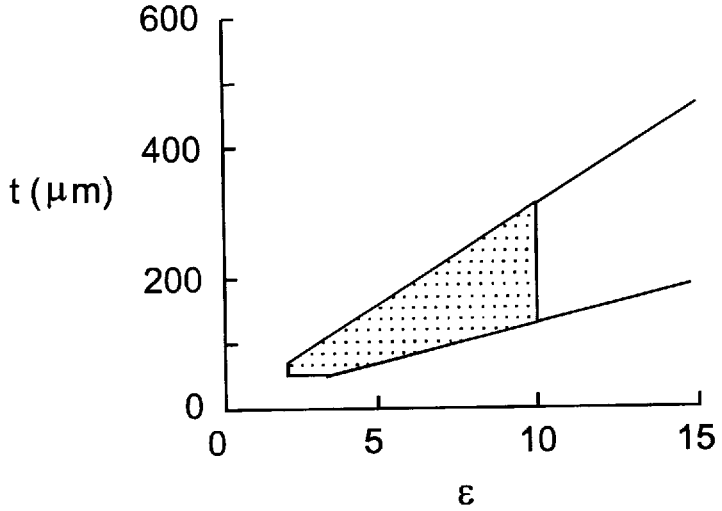
FIG. 13 is a diagram showing the ranges of the thickness t and the relative dielectric constant ∈ of a dielectric layer provided on the surface of a developer carrying member in the developing device according to the embodiment 2.

In the developer carrying member 11, a dielectric layer 11*d* is formed on the surface of a conductive base substrate 11*c* constructed by providing an elastic layer 11*b* having conductive properties around a rotating shaft 11*a* having conductive properties. An example of the dielectric layer 11*d* is one having a thickness t of not less than 50 μm and composed of a material having a relative dielectric constant ∈ of not more than 10, as shown in a shaded portion in FIG. 13, so that the thickness t of the dielectric layer 11*d* divided by the relative dielectric constant ∈ thereof (t/∈) is in the range of 15 to 35 μm. Examples of the material composing the dielectric layer 11*d* include various types of plastic materials, elastomer materials, and rubber materials, as in the above-mentioned embodiment 1.

In the developing device, a developer (toner) 12 is contained in the main body 10 of the developing device provided with the developer carrying member 11, and the developer 12 is fed toward the developer carrying member 11 by a rotating feeding blade 13. The developer 12 thus fed is fed to the surface of the developer carrying member 11 by a feeding roller 14 provided so as come into contact with the developer carrying member 11, and the developer 12 thus fed is conveyed toward the image carrying member by the rotation of the developer carrying member 11.

While the developer 12 is being thus conveyed to the image carrying member 1 by the developer carrying member 11, a regulating member 15 is pressed against the surface of the developer carrying member 11, to regulate the amount of the developer 12 conveyed to a developing area by the regulating member 15 as well as to frictionally charge the developer 12.

The developer 12 thus frictionally charged upon regulating the amount thereof by the regulating member 15 is thus introduced into the developing area opposite to the image carrying member 1 by the developer carrying member 11, the developer 12 is brought into contact with the surface of the image carrying member 1, and a DC voltage is exerted on a portion between the developer carrying member 11 and the image carrying member 1 from a power supply 16, to develop an electrostatic latent image formed on the surface of the image carrying member 1.

In a case where the electrostatic latent image formed on the image carrying member 1 is thus developed, even if the electrostatic latent image formed on the image carrying member 1 varies, the variation is prevented from appearing in a formed image upon being faithfully developed as it is, so that a good image is obtained. Particularly in a case where a laser optical system 2 is used for the exposing device 2, even if the beam diameter of its laser beam differs, a constant image is obtained.

In the developer carrying member 11, consider a case where an example of a material composing the elastic layer 11*b* having conductive properties provided around the rotating shaft 11*a* having conductive properties is one having a rubber hardness of 10 to 70 degrees and having elongation of 400 to 1200%. In this case, when the regulating member 15 is pressed against the surface of the developer carrying member 11 as described above, to regulate the amount of the developer 12 on the surface of the developer carrying member 11, the developer carrying member 11 is deformed, so that a load applied to the developer 12 is significantly reduced. Therefore, the developer 12 on the surface of the developer carrying member 11 is hardly cracked by pressing of the regulating member 11, so that the density of the formed image is prevented from being non-uniform in a stripe shape, for example, by welding fine powder of the developer 12 to the surface of the developer carrying member 11, for example.

It will be made clear on the basis of an experiment that the above-mentioned effect is obtained when the dielectric layer 11*d* having a thickness t of not less than 50 μm, having a relative dielectric constant ∈ of not more than 10, and having a value of t/∈ of 15 to 35 μm is provided on the surface of the developer carrying member 11.

(EXPERIMENTAL EXAMPLE 5)

In the experimental example 5, the image carrying member 1 was irradiated with a standard beam having a width in a horizontal scanning direction of 60 μm and having a width in a vertical scanning direction of 70 μm, a small-diameter beam having a width in a horizontal scanning direction of 55 μm and having a width in a vertical scanning direction of 65 μm, and a large-diameter beam having a width in a horizontal scanning direction of 70 μm and having a width in a vertical scanning direction of 80 μm from the laser optical system 2 used as the exposing device 2, to form electrostatic latent images.

As the developer carrying member 11, developer carrying members 11 respectively provided with dielectric layers 11*d* each composed of a material having a relative dielectric constant ∈ of approximately 3 and a material having a relative dielectric constant ∈ of approximately 8 and having a thickness t in the range of 0 to 150 μm were used.

In providing the dielectric layer 11*d* on the surface of the developer carrying member 11, the material having a relative dielectric constant ∈ of approximately 3 and the material having a relative dielectric constant ∈ of approximately 8 were used as the material composing the dielectric layer 11*d*. Dielectric layers 11*d* having thicknesses t of 0 μm, 50 μm, 100 μm, and 150 μm were respectively provided on the surfaces of developer carrying members 11 using each of the materials.

The image carrying member 1 was irradiated with the above-mentioned three types of laser beams, to form electrostatic latent images on the image carrying member 1. Development was performed by the developing device using each of the developer carrying members 11, to form a high-resolution and low-density halftone image composed of dots which has 200 screen lines, has a screen angle of 0°, and has a white-to-black ratio (a B/W ratio) of 11%, and the image density of the formed image was measured.

Figure 14:
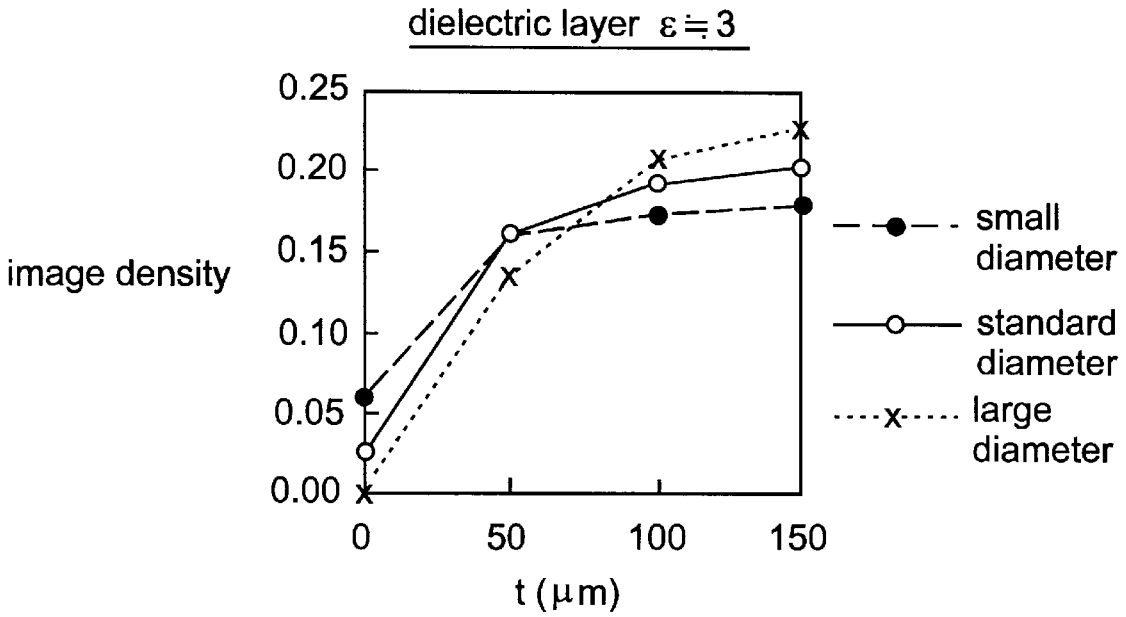
FIG. 14 is a diagram showing, in a case where electrostatic latent images are respectively formed on an image carrying member using three types of laser beams which differ in beam diameter, and the electrostatic latent images are respectively developed using developer carrying members provided with dielectric layers, which differ in thickness, composed of a material having a relative dielectric constant ∈ of approximately 3, the relationship between the image density of a formed image and the thickness of the dielectric layer.

In a case where the developer carrying member 11 provided with the dielectric layer 11*d* composed of the material having a relative dielectric constant ∈ of approximately 3 was used, the relationship between the thickness t of the dielectric layer 11*d* and the image density of the formed image was shown in FIG. 14. On the other hand, in a case where the developer carrying member 11 provided with the dielectric layer 11*d* composed of the material having a relative dielectric constant ∈ of approximately 8 was used, the relationship between the thickness t of the dielectric layer 11*d* and the image density of the formed image was shown in FIG. 15.

Figure 15:
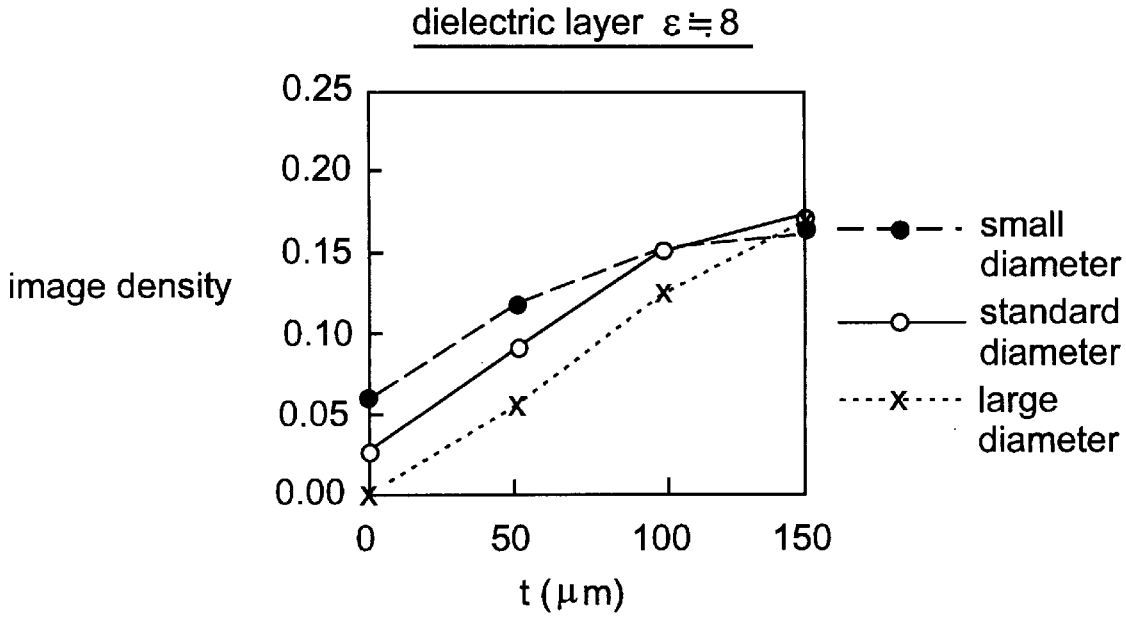
FIG. 15 is a diagram showing, in a case where electrostatic latent images are respectively formed on an image carrying member using three types of laser beams which differ in beam diameter, and the electrostatic latent images are respectively developed using developer carrying members provided with dielectric layers, which differ in thickness, composed of a material having a relative dielectric constant ∈ of approximately 8, the relationship between the image density of a formed image and the thickness of the dielectric layer.
Figure 16:
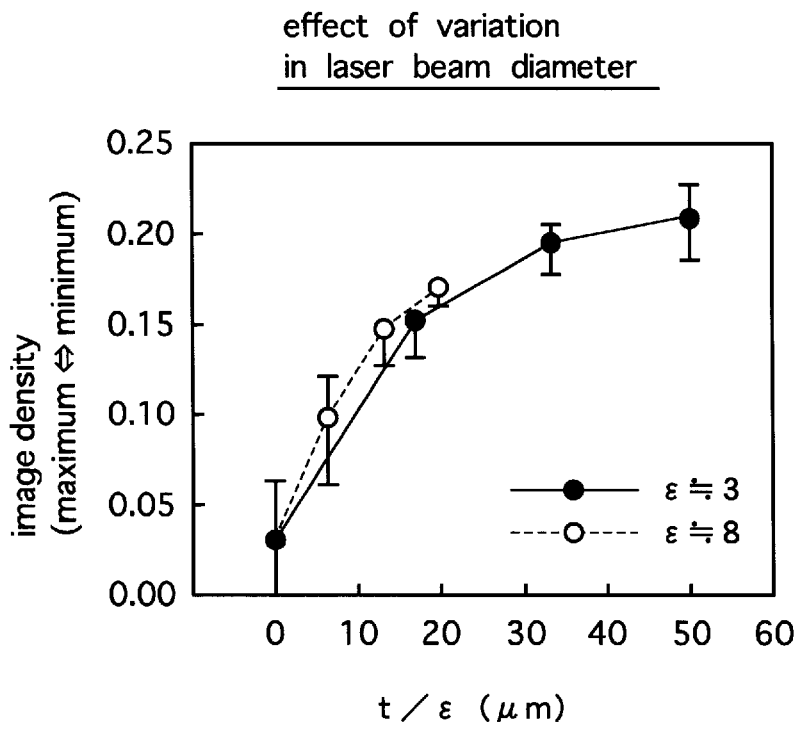
FIG. 16 is a diagram showing, in a case where electrostatic latent images are respectively formed on an image carrying member using three types of laser beams which differ in beam diameter, and the electrostatic latent images are developed, the relationship between the width of variation in the image density of a formed image and the thickness t of the dielectric layer in the developer carrying member divided by the relative dielectric constant ∈ thereof (t/∈).

On the basis of the results shown in FIG. 14 and FIG. 15, the relationship between the width of variation in the image density of an image formed upon developing the electrostatic latent image formed on the image carrying member 1 using each of the three types of laser beams which differ in beam diameter as described above by each of the developing devices and the thickness t of the dielectric layer 11*d* in the developer carrying member 11 divided by the relative dielectric constant ∈ thereof (t/∈) was found. The results thereof were shown in FIG. 16.

As a result, in either one of a case where the dielectric layer 11*d* using the material having a relative dielectric constant ∈ of approximately 3 was provided on the surface of the developer carrying member 11 and a case where the dielectric layer 11*d* using the material having a relative dielectric constant ∈ of approximately 8 was provided thereon, the image density hardly varied by the variation in beam diameter of the laser beam in a case where the thickness t of the dielectric layer 11*d* divided by the relative dielectric constant ∈ thereof (t/∈) was in the range of 15 to 35 μm.

In the developing device shown in FIG. 11, in then pressing the regulating member 15 against the surface of the developer carrying member 11 as described above, to regulate the amount of the developer 12 held on the surface of the developer carrying member 11, an experiment using developer carrying members 11 respectively having different types of elastic layers 11*b* having conductive properties provided around their rotating shaft 11*a* is carried out, to make it clear that the developer 12 is prevented from being cracked by pressing of the regulating member 15 when the developer carrying member 11 provided with the elastic layer 11*b* having a rubber hardness of 10 to 70 degrees and having elongation of 400 to 1200% is used.

In the experimental example, the same toner as the toner used in the above-mentioned experimental examples 1 to 4 was used as the developer 12.

(EXPERIMENTAL EXAMPLE 6)

In the experimental example 6, in providing the elastic layer 11*b* having conductive properties around the rotating shaft 11*a* in the developer carrying member 11, the elastic layer 11*b* having a rubber hardness of 44 degrees, having elongation of 710%, and having a specific volume resistivity of $10^6$ Ω·cm was provided, as shown in the following Table 2 using a styrene elastomer, and the dielectric layer 11*d* having a thickness of 80 μm was provided on the elastic layer 11*b* using the material having a relative dielectric constant ∈ of approximately 3.

(EXPERIMENTAL EXAMPLE 7)

In the experimental example 7, in providing the elastic layer 11*b* having conductive properties around the rotating shaft 11*a* in the developer carrying member 11, the elastic layer 11*b* having a rubber hardness of 77 degrees, having elongation of 850%, and having a specific volume resistivity of $10^5$ Ω·cm was provided, as shown in the following Table 2 using a styrene elastomer, and the dielectric layer 11*d* having a thickness of 80 μm was provided on the elastic layer 11*b* using the material having a relative dielectric constant ∈ of approximately 3.

(EXPERIMENTAL EXAMPLE 8)

In the experimental example 8, in providing the elastic layer 11*b* having conductive properties around the rotating shaft 11*a* in the developer carrying member 11, the elastic layer 11*b* having a rubber hardness of 68 degrees, having elongation of 980%, and having a specific volume resistivity of $10^5$ Ω·cm was provided, as shown in the following Table 2 using urethane rubber, and the dielectric layer 11*d* having a thickness of 80 μm was provided on the elastic layer 11*b* using the material having a relative dielectric constant ∈ of approximately 3.

(EXPERIMENTAL EXAMPLE 9)

In the experimental example 9, in providing the elastic layer 11*b* having conductive properties around the rotating shaft 11*a* in the developer carrying member 11, the elastic layer 11*b* having a rubber hardness of 50 degrees, having elongation of 290%, and having a specific volume resistivity of $10^6$ Ω·cm was provided, as shown in the following Table 2 using silicone rubber, and the dielectric layer 11*d* having a thickness of 80 μm was provided on the elastic layer 11*b* using the material having a relative dielectric constant ∈ of approximately 3.

A printing resistance test of 10,000 sheets was then carried out using the developer carrying members 11 shown in the above-mentioned experimental examples 6 to 9, to evaluate the non-uniformities in density of formed images. The results thereof were together shown in the following Table 2. In evaluating the non-uniformities in density of the images after the printing resistance test of 10,000 sheets, a case where a good image which is not non-uniform in density was obtained was indicated by ○, and a case where an image whose density is non-uniform in a stripe shape was obtained was indicated by X.

TABLE 2

| | rubber hardness (degree) | elongation (%) | specific volume resistivity (Ω · cm) | evaluation of non-uniformity in density |
|---|---|---|---|---|
| experimental example 6 | 44 | 710 | $10^6$ | ○ |
| experimental example 7 | 77 | 850 | $10^5$ | x |
| experimental example 8 | 68 | 980 | $10^5$ | ○ |
| experimental example 9 | 50 | 290 | $10^6$ | x |

As a result, in providing the elastic layer 11*b* having conductive properties around the rotating shaft 11*a* having conductive properties in the above-mentioned developer carrying member 11, in the experimental examples 6 and 8 in which the developer carrying member 11 was provided with the elastic layer 11*b* having a rubber hardness of 10 to 70 degrees and having elongation of 400 to 1200%, when the amount of the developer 12 on the surface of the developer carrying member 11 was regulated by the regulating member 15, fine powder of the developer 12 was prevented from being welded to the surface of the developer carrying member 11, for example, by the cracking of the developer 12, so that the formed image was not made non-uniform in density.

On the other hand, in the experimental example 7 in which the developer carrying member 11 was provided with the hard elastic layer 11*b* having a rubber hardness of 77 degrees, and in the experimental example 9 in which the developer carrying member 11 was provided with the elastic layer 11*b* having small elongation of 290%, when the amount of the developer 12 on the surface of the developer carrying member 11 was regulated by the regulating member 15, the developer 12 was cracked, producing fine powder, and the fine powder was welded to the surface of the developer carrying member 11, for example, so that the density of the formed image was made non-uniform in a stripe shape.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing device for developing a latent image formed on an image carrying member by a monocomponent developer containing no carrier, comprising:

a developer carrying member comprising a conductive base substrate and a dielectric layer formed on the surface of the conductive base substrate, the developer carrying member conveying the developer to a developing area opposite to the image carrying member with the developer held on its surface, wherein the dielectric layer in said developer carrying member satisfies the following conditions:

$$t \geqq 50,\ \in \leqq 10,\ \text{and}\ 15 \leqq t/\in \leqq 35$$

where t ($\mu$m) is the thickness of the dielectric layer, and $\in$ is the relative dielectric constant of the dielectric layer.

2. The developing device according to claim 1, further comprising a regulating member pressed against the surface of said developer carrying member for regulating the amount of the developer conveyed to the developing area, wherein at least the surface of the conductive base substrate in said developer carrying member is formed of an electrically conductive material having a rubber hardness of 10 to 70 degrees and having elongation of 400 to 1200%.

3. The developing device according to claim 1, wherein said developer carrying member is disposed opposite to said image carrying member with predetermined spacing.

4. The developing device according to claim 3, wherein the spacing between said developer carrying member and said image carrying member is in the range of 150 to 400 $\mu$m.

5. The developing device according to claim 1, wherein said developer carrying member and said image carrying member are brought into contact with each other in the developing area.

6. A developing device for developing a latent image formed on an image carrying member by a monocomponent developer containing no carrier, comprising:

a developer carrying member comprising a conductive base substrate and a dielectric layer formed on the surface of the conductive base substrate, the developer carrying member being disposed opposite to said image carrying member with predetermined spacing and conveying the developer to a developing area opposite to the image carrying member with the developer held on its surface, wherein the spacing between said image carrying member and said developer carrying member is in the range of 150 to 400 $\mu$m, and the dielectric layer in said developer carrying member satisfies the following conditions:

$$t \geqq 50,\ \in \leqq 10,\ \text{and}\ 10 \leqq t/\in \leqq 50$$

where t ($\mu$m) is the thickness of the dielectric layer, and $\in$ is the relative dielectric constant of the dielectric layer.

7. The developing device according to claim 6, wherein the dielectric layer in said developer carrying member satisfies the following condition:

$$30 \leqq t/\in \leqq 50.$$

8. The developing device according to claim 6, further comprising a regulating member pressed against the surface of said developer carrying member for regulating the amount of the developer conveyed to the developing area, wherein at least the surface of the conductive base substrate in said developer carrying member is formed of an electrically conductive material having a rubber hardness of 10 to 70 degrees and having elongation of 400 to 1200%.

9. The developing device according to claim 8, wherein the dielectric layer in said developer carrying member further satisfies the following condition:

$$30 \leqq t/\in \leqq 50.$$

10. The developing device according to claim 6, wherein said developer carrying member is a cylindrical member, and roller members for defining the spacing between the developer carrying member and the image carrying member are provided at both ends of the developer carrying member.

11. The developing device according to claim 10, wherein the dielectric layer in said developer carrying member satisfies the following condition:

$$30 \leqq t/\in \leqq 50.$$

12. The developing device according to claim 10, further comprising a regulating member pressed against the surface of said developer carrying member for regulating the amount of the developer conveyed to the developing area, wherein at least the surface of the conductive base substrate in said developer carrying member is formed of an electrically conductive material having a rubber hardness of 10 to 70 degrees and having elongation of 400 to 1200%.

13. The developing device according to claim 12, wherein the dielectric layer in said developer carrying member further satisfies the following condition:

$$30 \leqq t/\in \leqq 50.$$

14. The developing device according to claim 6, further comprising a voltage applying unit for applying a developing bias voltage in which an AC voltage is overlapped with a DC voltage to a portion between said image carrying member and the developer carrying member.

15. The developing device according to claim 14, wherein the dielectric layer in said developer carrying member further satisfies the following condition:

$$30 \leqq t/\in \leqq 50.$$

16. The developing device according to claim 14, further comprising a regulating member pressed against the surface of said developer carrying member for regulating the amount of the developer conveyed to the developing area, wherein at least the surface of the conductive base substrate in said developer carrying member is formed of an electrically conductive material having a rubber hardness of 10 to 70 degrees and having elongation of 400 to 1200%.

17. The developing device according to claim 16, wherein the dielectric layer in said developer carrying member further satisfies the following condition:

$$30 \leqq t/\in \leqq 50.$$

18. A developer carrying member used for a developing device for developing a latent image formed on an image carrying member by a monocomponent developer containing no carrier and disposed opposite to said image carrying member with predetermined spacing, comprising:

a conductive base substrate; and a dielectric layer formed on the surface of said conductive base substrate, wherein said predetermined spacing is in the range of 150 to 400 $\mu$m, and said dielectric layer satisfies the following conditions:

$$t \geqq 50,\ \in \leqq 10, \text{ and } 10 \leqq t/\in \leqq 50$$

where t ($\mu$m) is the thickness of the dielectric layer, and $\in$ is the relative dielectric constant of the dielectric layer.

19. The developer carrying member according to claim 18, wherein said dielectric layer satisfies the following condition:

$$30 \leqq t/\in \leqq 50.$$

20. The developer carrying member according to claim 18, wherein said developing device comprises a regulating member pressed against the surface of said developer carrying member for regulating the amount of the developer conveyed to the developing area, at least the surface of the conductive base substrate is formed of an electrically conductive material having a rubber hardness of 10 to 70 degrees and having elongation of 400 to 1200%.

21. The developer carrying member according to claim 20, wherein the dielectric layer satisfies the following condition:

$$30 \leqq t/\in \leqq 50.$$

22. A developing device for developing a latent image formed on an image carrying member by a monocomponent developer containing no carrier, comprising:

a developer carrying member comprising a conductive base substrate and a dielectric layer formed on the surface of the conductive base substrate, the developer carrying member being disposed opposite to said image carrying member and conveying the developer to a developing area opposite to the image carrying member with the developer held on its surface, to bring said developer into contact with the surface of the image carrying member, wherein the dielectric layer in said developer carrying member satisfies the following conditions:

$$t \geqq 50,\ \in \leqq 10, \text{ and } 15 \leqq t/\in \leqq 35$$

where t ($\mu$m) is the thickness of the dielectric layer, and $\in$ is the relative dielectric constant of the dielectric layer.

23. The developing device according to claim 22, further comprising a regulating member pressed against the surface of said developer carrying member for regulating the amount of the developer conveyed to the developing area, wherein at least the surface of the conductive base substrate in said developer carrying member is formed of an electrically conductive material having a rubber hardness of 10 to 70 degrees and having elongation of 400 to 1200%.

24. A developer carrying member used for a developing device for developing a latent image formed on an image carrying member by a monocomponent developer containing no carrier for conveying the developer to a developing area opposite to the image carrying member with the developer held on its surface, to bring the developer into contact with the surface of the image carrying member, comprising:

a conductive base substrate; and a dielectric layer formed on the surface of said conductive base substrate, wherein said dielectric layer satisfies the following conditions:

$$t \geqq 50,\ \in \leqq 10, \text{ and } 10 \leqq t/\in \leqq 50$$

where t ($\mu$m) is the thickness of the dielectric layer, and $\in$ is the relative dielectric constant of the dielectric layer.

25. The developer carrying member according to claim 24, wherein said developing device comprises a regulating member pressed against the surface of said developer carrying member for regulating the amount of the developer conveyed to the developing area, and at least the surface of the conductive base substrate is formed of an electrically conductive material having a rubber hardness of 10 to 70 degrees and having elongation of 400 to 1200%.

* * * * *